United States Patent [19]

Yanda

[11] 4,034,497

[45] July 12, 1977

[54] SELF-DEFENSE DEVICE

[76] Inventor: Roman L. Yanda, 15243 Vanowen St., Suite 307, Van Nuys, Calif. 91405

[21] Appl. No.: 638,325

[22] Filed: Dec. 8, 1975

Related U.S. Application Data

[63] Continuation of Ser. No. 458,595, April 8, 1974, abandoned.

[51] Int. Cl.[2] ..... F42B 5/16

[52] U.S. Cl. ..... 42/1 G; 102/39; 102/90

[58] Field of Search ..... 102/6, 39, 57–59, 102/65, 66, 90; 42/1 F, 1 G; 239/135, 136; 222/146 HS

[56] References Cited

U.S. PATENT DOCUMENTS

| | | | |
|---|---|---|---|
| 1,530,133 | 3/1925 | Maxwell | 102/65 |
| 1,567,659 | 12/1925 | Lawrence | 102/90 |
| 2,000,131 | 5/1935 | Goss | 102/65 |
| 2,884,836 | 5/1959 | Allen | 102/57 |

*Primary Examiner*—Verlin R. Pendegrass
*Attorney, Agent, or Firm*—Edward C. Walsh

[57] ABSTRACT

Self-defense device has a charge of liquid, preferably substantially water so that, when the device is actuated, it is heated and expelled from a nozzle to be directed at an assailant. Heating of the water may also develop gas pressure which causes the expelling of the water, or heating may cause boiling to result in both pressurization and water expulsion. Black powder and cordite comprise mixtures which, when combusted, cause heating of the water and expelling of the water by separate gas generation. In other cases, a material can react with the liquid to cause expelling of hot liquid. An example of this is alkaline metal, such as sodium, being admixed with the water when expelling is desired.

9 Claims, 6 Drawing Figures

SELF-DEFENSE DEVICE

This is a continuation of application Ser. No. 458,595 filed on Apr. 8, 1974, and now abandoned.

BACKGROUND

1. Field of the Invention

This invention is directed to a self-defense device and particularly a device which is portable and can be directed to discharge hot water at an assailant.

2. Prior Art

When a person is attacked, unless the person is either physically or technologically in a position to be an aggressor, there is no effective defense, except surrender. Most people who are attacked go into the passive shock of surrender; however, some have weapons, and fear makes these attacked persons use the weapons, quite often unwisely. These persons are at an even greater risk. In addition to the potential for the attacker becoming violent, the person being attacked through error may seriously injure or even kill an innocent person. All too often, the injured person is one of their own family or peer group. At present, there does not appear to be a defense device which is convenient to carry, of adequate reliability, and of such nature to provide an adequate defense without serious harm.

The prior art seems to lack a reliable non-lethal self-defense and deterrent device. The device should be such that it would not be capable of killing under almost any circumstances. Such a device should be reliable and must be able to keep an attacker at greater than arm's length. The self-defense device must be utilizable by an unskilled person, even when he is in fear of his life, and utilizable for a long enough time to either get away or get help or drive away the attacker and possibly mark him for subsequent identification so that subsequent capture is aided.

SUMMARY

In order to aid in the understanding of this invention, it can be stated in essentially summary form that it is directed to a self-defense device. The self-defense device includes a chamber having a nozzle which is directable at an assailant. A liquid is positioned in the chamber for discharge out of the nozzle, and heater-propellant means is provided to heat and expel the liquid out of the nozzle to provide defense.

It is an object of this invention to provide a self-defense device which is readily employed and can be directed by a person being attacked toward an attacker to provide effective defense. It is a further object to provide a self-defense device which comprises a device which discharges heated liquid at an attacker. It is a further object to provide a device which is a non-lethal defense and deterrent device which permits the attacked person to discharge a jet of heated liquid, preferably essentially water, at an attacker with the jet being sufficiently strong and sufficiently hot to abort the attack.

It is a further object to provide a self-defense device which comprises a charge of water in a vessel which charge can be quickly heated and pressurized for the discharge of hot water out of a nozzle to be directed at an assailant.

The features of the present invention which are believed to be novel are set forth in particularity in the appended claims. The present invention, both as to its organization and manner of operation, together with further objects and advantages thereof, may be understood best by reference to the following description taken in connection with the accompanying drawings.

DESCRIPTION OF THE PREFERRED EMBODIMENTS

Figure 1:
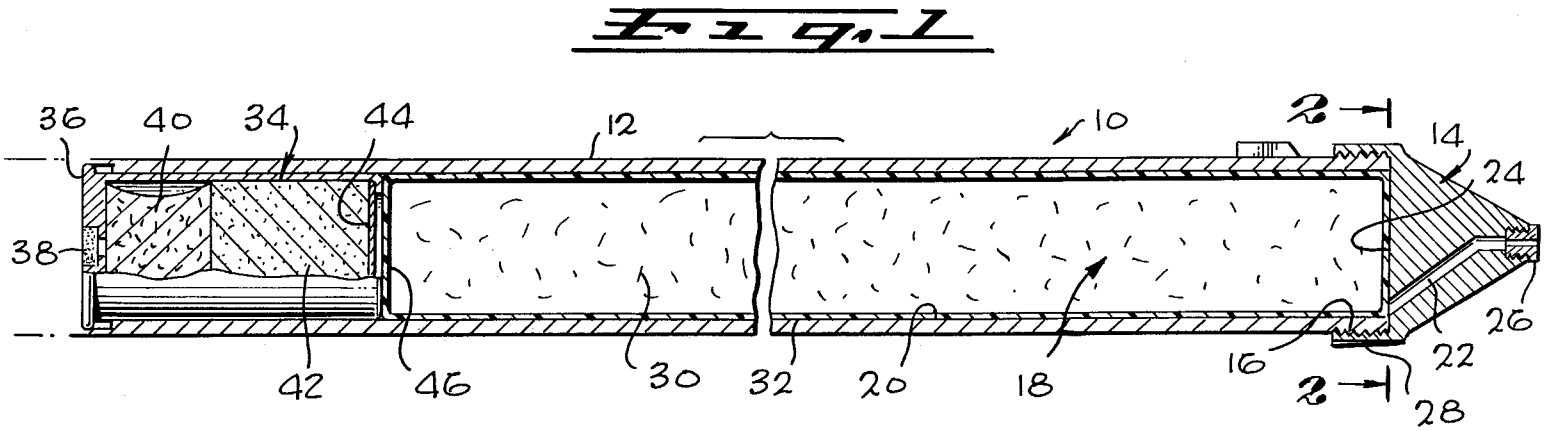
FIG. 1 is a longitudinal section through the preferred embodiment of the self-defense device of the invention.

The preferred embodiment of the self-defense device of this invention is generally indicated at 10 in FIG. 1. Device 10 has a barrel 12 which is in tubular cylindrical form, which in the drawings resembles the barrel of a large bore gun, such as a shotgun. The forward end of barrel 12 carries nozzle assembly 14 which is removably mounted upon the front end of the barrel by means of screw thread 16. Barrel 12 is hollow, with interior space 18 defined by interior barrel walls 20. Nozzle assembly 14 closes the forward end of the barrel and has an interior passage 22 leading from the face 24 of the nozzle assembly upward and forward to terminate in forwardly directed jet nozzle 26. Jet nozzle 26 may be in the form of a replaceable nozzle in nozzle assembly 14, as shown in FIG. 1, or may be built right into the nozzle assembly. Jet nozzle 26 is of such dimensions as to produce a solid liquid stream on the target at a distance of at least 6 feet for a substantial duration of time, as described in more detail below.

Nozzle assembly 14 has indicia 28 thereon which is positioned with respect to passage 22. By inspection of the indicia, the position of the passage is shown. This is necessary so that, when the nozzle assembly 14 is installed on the front end of barrel 12, the passage 22 at face 24 is at the lower side of space 18. The indicia may be of any convenient type to accomplish this result.

Liquid 30 is positioned in space 18 in vessel 32. Vessel 32 is of thin material and need not be self-supporting, but is employed to separate the liquid from the barrel in order to prevent degradation of either one of them. Vessel 32 is conveniently a shaped thin-walled polymer composition vessel, but it may be a wax lining within the barrel.

It is the purpose of liquid 30 to be heated and expelled out of nozzle 26, and the nature of the liquid is dependent upon the nature of the material which will provide the heating and the propulsion. In the preferred embodiment illustrated in FIG. 1, liquid 30 is a water solution of acid. The acid can be hydrochloric acid or acetic acid or the like. Vessel 32 is chosen to be compatible with the liquid 30.

Cartridge 34 is positioned in the back end of barrel 12 so that it closes the barrel. A breech block or bolt is provided so that it engages upon the back end of the cartridge behind rim 36 to hold the cartridge in place.

The breech block structure is also provided with a firing pin operated by a conventional trigger.

Cartridge 34 has a primer 38, such as of mercury fulminate, which is ignited by percussion of the firing pin. The tubular structure of cartridge 34 is similar to that of a shotgun shell, but interiorly instead of firing a powder as in the preferred embodiment of FIG. 1, the firing of primer 38 thrusts wad 40 forward. Forward of the wad is a body of granular alkaline metal 42. The alkaline metal is preferably sodium or potassium. Cartridge 34 is conventionally closed on the front end after loading so that it can be handled and placed into barrel 12. It is seen that, upon firing of primer 38, the alkaline metal 42 in granular form is thrust forward to thrust out the front seal 44 and thrust through the rear wall 46 of vessel 32 so that the alkaline metal is discharged into liquid 30. As previously stated, liquid 30 is substantially water. The result is an exothermic reaction with the sodium going to sodium hydroxide and resulting in the evolvement of hydrogen. The acid originally in liquid 30 is of such strength as to substantially neutralize the sodium hydroxide product. The result of this exothermic reaction with gas generation is the heating of the liquid 30 and its pressurization to cause forceful discharge out of nozzle 26. The details are given in examples below.

It is seen that barrel 12 can conveniently be the barrel of a shotgun. The breech, firing pin and trigger mechanism of a shotgun need not be modified. The forward end of the barrel need be equipped with threads 16 so that nozzle assembly 14 can be installed thereon but, in some shotguns, the threads are already provided for the installation of chokes and similar devices. Vessel 32 is designed to be of such length that it extends up into the chamber of the shotgun so that a conventional standard full-size shotgun shell cannot be inserted thereabove and the breech closed. Cartridge 32 is shorter than the standard shotgun shell, and this feature prevents the inadvertent installation of a standard shotgun shell with the resulting danger.

In the preferred embodiment shown in FIG. 1, the cartridge employs alkaline metal which reacts with the water to result in the generation of heat and pressure. Other hypergolic mixtures are possible, for example, hydrazine in the cartridge to heat and pressurize water in the vessel. Furthermore, hydrazine in the cartridge can be mixed with other materials to provide other types of hypergolic action, such as hydrazine hydrate plus methanol or hydrazine hydrate plus $N_2O_2$. However, these materials are less stable and less safe in handling.

Figure 3:
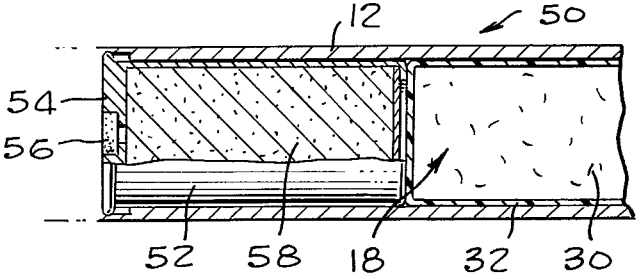
FIG. 3 is a partial section similar to FIG. 1, but showing a different means for heating and expelling liquid.
Figure 2:
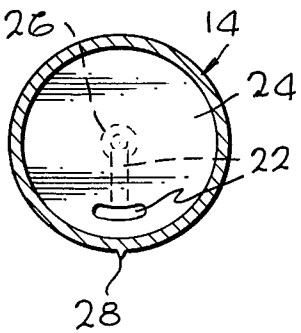
FIG. 2 is a section taken generally along the line 2—2 of FIG. 1.

The self-defense device 50 illustrated in FIG. 3 has the same barrel 12, space 18 in the barrel, and liquid 30 in vessel 32 in the forward end of the barrel as the device 10. Furthermore, the front end of the barrel is closed by a nozzle assembly 14, and the rear end is closed by a breech, as described with respect to FIG. 1. Cartridge 52 is positioned within barrel 12 and is retained in place by the bolt or breech block. Cartridge 52 has a cap 54 in which is located primer 56. The primer is actuatable by any convenient means, such as by being struck by conventional firing pin. Cartridge 52 contains combustible material 58 which contains its own oxidizer so that, upon actuation of primer 56, combustion takes place. Combustible material 58 can be a carbon-nitrate mixture such as black powder, or can be a nitrocellulose smokeless powder such as cordite, or it can be any other fuel-oxidizer mixture which produces heat and gas upon combustion. Upon actuation, cartridge 52 causes discharge of hot gas into liquid 30, which is preferably water, to cause heating of the water. The amount of heat evolved from combustion of combustible material 58 may be sufficient to raise the water to 212° F so that, upon discharge from the nozzle, the water is at steaming temperature. Super heat of the water; that is, raising it substantially above 212° F by the release of sufficient heat from the combustible material 58, is to be avoided because the superheated water discharging from nozzle 26 and being released from its pressure within the barrel to the atmospheric pressure would cause boiling of the stream and thus breakdown of the stream properties. While a maximum stream temperature is desired, the temperature should not be sufficient to cause detrimental effects to solid stream flow.

The liquid preferably contains an indelible dye as a marker. The dye can be water-soluble at room temperature and can become indelible at elevated temperatures so that, when the liquid is directed to a person, he is semipermanently marked. If desired, the dye can be activatable by the ultraviolet light so that it fluoresces to be especially visible at night. In this way, attackers can be identified. Also, a small amount of long-chain, non-toxic, non-corrosive polymer can be employed in the water to maintain stream shape as it leaves the nozzle to improve stream integrity and effectiveness.

Figure 4:
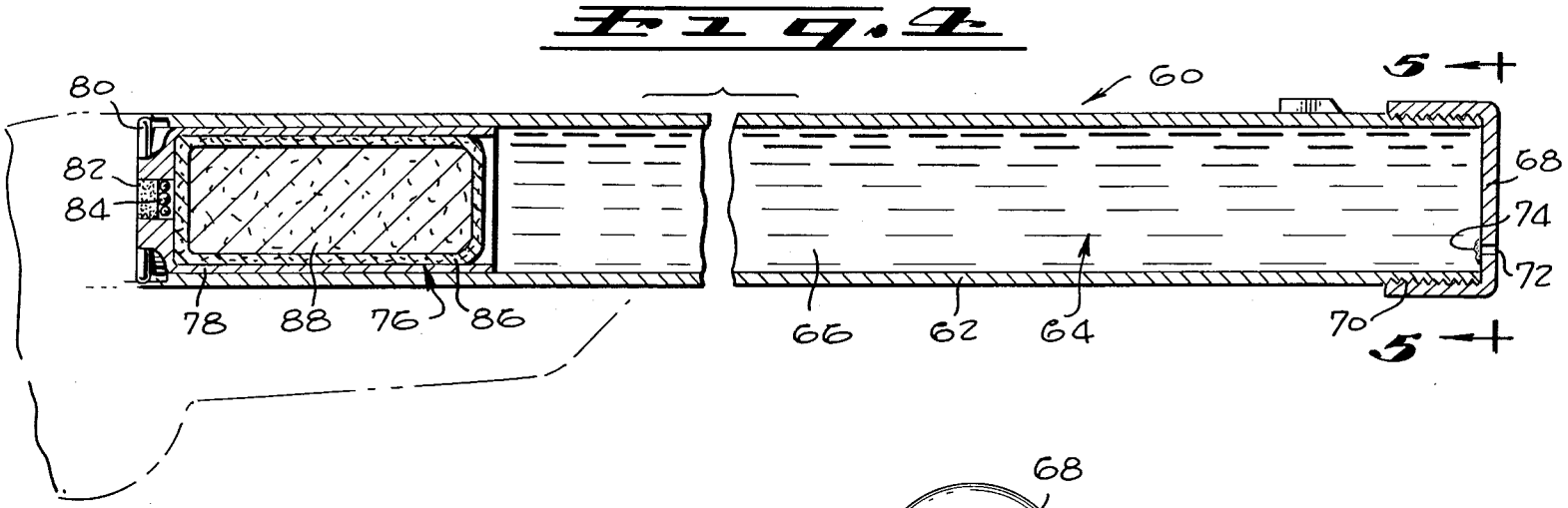
FIG. 4 is a longitudinal section through another embodiment of the device of this invention.
Figure 5:
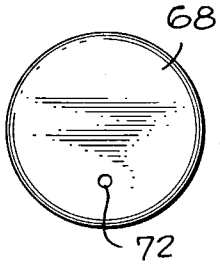
FIG. 5 is an end view seen generally along the line 5—5 of FIG. 4.

FIG. 4 illustrates self-defense device 60. Device 60 comprises a barrel 62 which is in tubular form having an interior space 64 in which is located liquid 66. The forward end of barrel 62 has a cap 68 fastened thereon as by threads 70. Cap 70 is a nozzle assembly, such as nozzle assembly 14, and has a nozzle opening 72 therein. Nozzle opening 72 is plugged by means of a soft, preferably temperature-sensitive plug 74. Plug 74 can be wax to hold liquid 66 in the barrel. The rear end of the barrel contains cartridge 76. Cartridge 76 is of the general exterior appearance of a shotgun shell, but is shorter. The chamber of the barrel 62 is arranged so that a standard shotgun shell cannot be inserted therein. Cartridge 76 has a casing 78 which terminates in cap 80. Cap 80 carries primer 82 and, located beyond the primer are several small loose balls 84. Container 86 is positioned within the cartridge casing and encloses alkaline metal 88. The alkaline metal is preferably sodium or potassium and is preferably in granular form. The casing 86 is preferably wax to protect the alkaline metal against moisture. Upon firing of cartridge 76 by means of a conventional firing pin striking primer 82, the primer drives balls 84 through the wax casing with sufficient strength that the alkaline metal bursts out of the front end of casing 86 so that it intimately intermixes with water 66 to cause a hypergolic reaction. The development of heat and pressure causes discharge of a hot-water jet 90 out of nozzle opening 72. Heat and pressure are developed to discharge a substantial stream of hot water for a substantial time.

Figure 6:
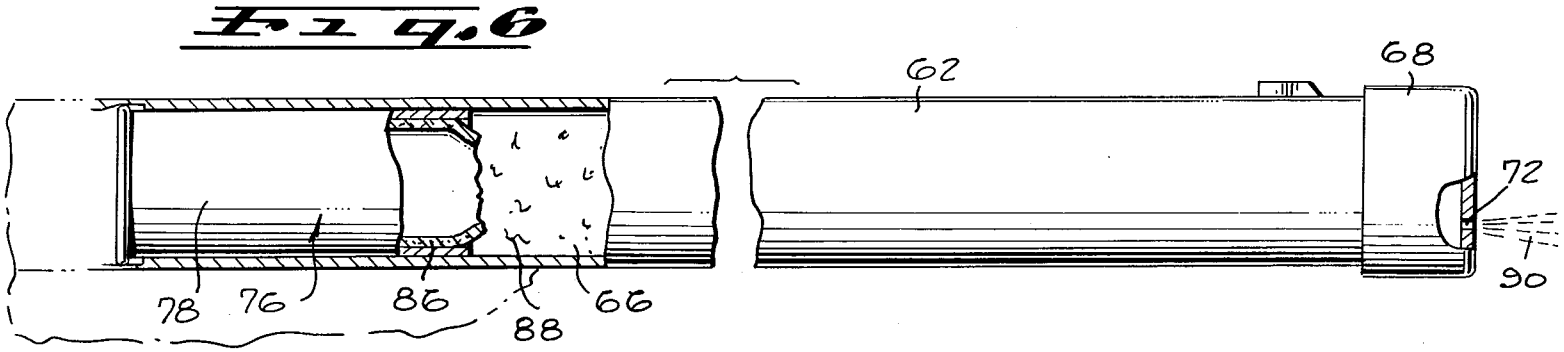
FIG. 6 is a side-elevational view, with parts broken away and parts shown in section, showing the embodiment of FIG. 4 in the activated condition where the discharge of heated liquid is taking place.

FIGS. 4 and 6 especially show a breech in dashed lines to the left end of the figures. This represents a structure in which a standard shotgun is employed to provide the barrel, the chamber closing mechanism, and the firing mechanism. It is a convenient source of the mechanism for building a model. A single-barrel shotgun can be provided with the threads for the attachment of the cap with its nozzle. When the embodiment is as in FIGS. 1 and 3 with a vessel 32 within the barrel, the vessel is of sufficient length so that the cartridge 34 is a shorter than standard length cartridge. In that case, if a standard shotgun shell is loaded, the breech cannot be closed. This is a safety factor so that, when the liquid vessel is in the barrel, standard explosive charges cannot be used. It is believed preferable that the self-defense device does not look like a gun because, when a person is defending himself, he does not want his assailant to believe that he is carrying a gun, because an assailant may produce a gun and then cause severe harm or death to the defender. Thus, it would be better that the self-defense device have another shape. A tube with a firing mechanism on one end and a nozzle on the other would suffice, although it is preferred that a thermal insulated handle be provided adjacent to the breech end so that the defender can strongly retain the device. Preferably, the barrel of the device becomes hot so that the attacker cannot wrest the device away by grabbing the barrel.

In summary, the cartridge provides pressure to expel the liquid out of the nozzle and, at the same time, provides heat for heating the liquid so that hot liquid is expelled at high pressure. Preferably, the liquid is substantially water, and the water raised to a high enough temperature, such as 160° to 210° F to cause the attacker to withdraw. The examples below give some calculations and some actual tests of various liquids and various cartridge charges.

EXAMPLE I

It was calculated that the energy released from a 5-gram charge of cordite smokeless powder is sufficient to heat 50 grams of water from 25° to 100° C and volatilize about 2 grams of that water. It was estimated that the gaseous product of the cordite combustion would generate the pressures from 2,000 to 10,000 psi when the original space is completely filled with liquid and cordite charge. In order to prevent the high pressure, it is proposed that in such a structure a collapsible filler such as a low density closed cell foam be placed within the barrel space. Such a filler would enable design which would limit the initial pressure to 500 psi.

EXAMPLE II

This is a calculated example of the employment of sodium as the heating and gas generating material in conjunction with water. In this calculation, 100 cc of water is reacted with 48 grams (50 cc) of sodium metal. Space 18 also contains 100 cc of a pressure-limiting collapsible filler such as a low density closed cell foam. When triggered, the sodium and water will react to form 80 grams of sodium hydroxide, plus 22.4 liters of hydrogen at STP and 8,080 calories of heat. The 8,080 calories of heat will raise the temperature of 100 cc of water from 25° to 100° C and volatilize 6 cc of water into steam at 100° C. Total gas generated will be 22.4 liters of hydrogen and 8.4 liters of water vapor. The pressure rise will be to about 2,270 psi initially, then falling to 1,830 psi in a few microseconds.

EXAMPLE III

The conditions in Example III are the same as in Example II, except that the 100 cc of water contains 1 mole of hydrochloric acid. The reaction of the 46 grams of sodium produces 80 grams of sodium hydroxide, which is 1 mole. The water in this example contains 1 mole of hydrochloric acid and thus the acid reacts with a base to produce sodium chloride and 7,000 calories. This permits reduction in the initial load of sodium and provides a neutralized hot liquid jet stream.

EXAMPLE IV

In an actual test, 6 ounces of water were reacted with 4 to 6 grams of sodium to obtain a discharge distance of about 8 feet out of a nozzle formed of an ⅛ inch nominal pipe. About 3.5 ounces of the water were discharged out of the jet with a discharge time of approximately 1 minute. The water remaining in the original liquid space was raised in temperature from 67° to 96° F.

EXAMPLE V

Sixteen ounces of water initially at 70° F were reacted with sodium to discharge the water 14 feet out of a nominal ⅛ inch pipe nozzle. Six ounces of water remained at 83° F. In subsequent experiments, an acetic acid solution was used instead of water, and this produced less noxious fumes. In an additional test, a small amount of a long-chain, non-toxic, non-corrosive polymer was employed to maintain the jet stream shape of the discharging water. The inclusion of the polymer aided in preventing dispersal of the water jet. While actual tests did not measure the temperature of the jet of discharged liquid, further calculations and tests would provide the proper quantities of materials, as well as the proper dispersion of heat production activity in the liquid so that the jet is discharged at an adequately high temperature to be effective, as well as with proper force and for an adequate length of time to provide an effective self-defense device.

This invention having been described in its preferred embodiment and other embodiments having been illustrated, it is clear that the invention is susceptible to numerous modifications and embodiments within the ability of those skilled in the art and without the exercise of the inventive faculty. Accordingly, the scope of this invention is defined by the scope of the following claims.

What is claimed is:

1. A non-lethal self-defense device comprising:
   - an enclosed liquid container; a chamber associated with said container to receive liquid activating means;
   - a restricted nozzle communicating with the liquid container to the exterior; the device having a construction whereby the nozzle can be manually directed in a desired direction;
   - non-toxic liquid in said container;
   - means for normally preventing said liquid from leaking out of said nozzle; and
   - activating means for heating and pressurizing said liquid in said container so that pressure is generated in said container and said liquid is heated and to inactivate said means for preventing liquid leaking out of said nozzle whereby a solid stream of heated liquid can be directed to repel an attacher while the device is manually held, said activating means including cartridge means insertable into said chamber, the cartridge means including material which brings about heating and pressurization of the liquid, said means for heating and pressurizing said liquid being a self-combusting means, said self-combusting means being black powder.
2. A non-lethal self-defense device comprising:

an enclosed liquid container; a chamber associated with said container to receive liquid activating means;

a restricted nozzle communicating with the liquid container to the exterior; the device having a construction whereby the nozzle can be manually directed in a desired direction;

non-toxic liquid in said container;

means for normally preventing said liquid from leaking out of said nozzle; and activating means for heating and pressurizing said liquid in said container so that pressure is generated in said container and said liquid is heated and to inactivate said means for preventing liquid leaking out of said nozzle whereby a solid stream of heated liquid can be directed to repel an attacher while the device is manually held, said activating means including cartridge means insertable into said chamber, the cartridge means including material which brings about heating and pressurization of the liquid, said means for heating and pressurizing said liquid being a self-combusting means, said self-combusting means being a smokeless nitrate explosive.

3. A non-lethal self-defense device comprising:

an enclosed liquid container; a chamber associated with said container to receive liquid activating means;

a restricted nozzle communicating with the liquid container to the exterior; the device having a construction whereby the nozzle can be manually directed in a desired direction;

non-toxic liquid in said container;

means for normally preventing said liquid from leaking out of said nozzle; and activating means for heating and pressurizing said liquid in said container so that pressure is generated in said container and said liquid is heated and to inactivate said means for preventing liquid leaking out of said nozzle whereby a solid stream of heated liquid can be directed to repel an attacher while the device is manually held, said activating means including cartridge means insertable into said chamber, the cartridge means including material which brings about heating and pressurization of the liquid, said liquid comprising water and said means for heating and pressurizing said liquid comprising means for mixing alkaline metal with said liquid.

4. The self-defense device of claim 3 wherein said alkaline metal is positioned in the said cartridge means along with an explosive for propelling said alkaline metal, when said explosive is acutated, out of said cartridge means into said liquid.

5. The self-defense device of claim 4 wherein said alkaline metal is sodium and said sodium is sealed in a waxed container, said sodium being ejected from said waxed container upon actuation of said explosive.

6. The self-defense device of claim 5 wherein said cartridge means contains said explosive as a mechanically actuatable explosive primer, and a wad is positioned between said explosive primer and said sodium, said sodium being in granular condition so that, upon actuation of said primer, said wad expels granular sodium in the said liquid.

7. The self-defense device of claim 3 wherein said liquid is contained in a vessel in said container so that, prior to actuation, said liquid does not engage said container walls.

8. The self-defense device of claim 7 wherein said vessel is a rupturable vessel so that, when said liquid is heated and pressurized in said vessel, it ruptures at said nozzle opening to permit discharge of liquid in a heated jet stream.

9. The device as in claim 3, wherein the device is constructed to be manually held and utilized and the enclosed container being constructed in the form of a barrel like a gun barrel and the nozzle being constructed in a relationship to the container whereby a relatively solid stream of liquid can be ejected for a given period of time.

* * * * *